United States Patent [19]

Hartman et al.

[11] Patent Number: 4,826,262

[45] Date of Patent: May 2, 1989

[54] ELECTRONIC TOWEL DISPENSER

[75] Inventors: Kenneth D. Hartman, DeKalb; Donald B. Owen, Villa Park, both of Ill.

[73] Assignee: Steiner Company, Inc., Utah

[21] Appl. No.: 164,456

[22] Filed: Mar. 4, 1988

[51] Int. Cl.[4] ..... B65H 19/00

[52] U.S. Cl. ..... 312/38; 83/208

[58] Field of Search ..... 83/208; 312/38, 39

[56] References Cited

U.S. PATENT DOCUMENTS

| | | | |
|---|---|---|---|
| 2,095,021 | 10/1937 | Belenson | 312/38 |
| 3,858,953 | 1/1975 | Bahnsen | 312/38 |
| 3,893,738 | 7/1975 | Bahnsen | 312/38 |
| 4,010,988 | 3/1977 | Schwartz | 312/38 |
| 4,676,131 | 6/1987 | Cassia | 83/208 |
| 4,676,559 | 6/1987 | Hood et al. | 312/38 |
| 4,738,176 | 4/1988 | Cassia | 83/208 |

*Primary Examiner*—Joseph Falk

*Attorney, Agent, or Firm*—Emrich & Dithmar

[57] ABSTRACT

A continuous towel dispenser includes a sensor which detects the disruption of the radio frequency (RF) field below the dispenser's cabinet caused by movement of a user's hands in withdrawing unused towel from a towel from supply roller and provides a control signal to a towel dispensing motor coupled to a supply roller allowing the towel to be dispensed for a predetermined time period corresponding to a desingated towel length. At the same time, a control signal initiates downward displacement of a towel idler bar allowing a length of used towel to also be withdrawn from the cabinet. After a predetermined time interval, e.g., 5 seconds, a towel takeup cycle is automatically initiated by upward displacement of the idler bar followed by a reversal in the direction of rotation of the towel takeup roller. The towel takeup cycle continues for a designated time period or until a stall current in a towel takeup motor is detected indicating that all of the towel has been withdrawn into the cabinet. Inhibit means prevents additional unused towel from being withdrawn during a hand drying cycle.

23 Claims, 3 Drawing Sheets

102
CABINET OPEN SENSOR 62
POWER SUPPLY 64
90
HAND 26 SENSOR
94
G1
T6
66
BAR DOWN LIMIT SWITCH
G2
G8
32
G3
G9
68
BAR UP LIMIT SWITCH
T5
G22
G5
T- T+
G4
Q Q
CL R
G10
Q Q
G6
96
T1
T2
G7
T+
G11
R
Q
S R
G12
Q
G23
28
G25
CL R
G13
Q Q
G14
T3
G24
T4
G26
G15
T+ T-
G17
Q Q
CL R
G16
Q Q
92
98
G18
30
G28
G29
G27
T7
R S
G21
Q
100
G19
T-
Q Q
R1
R CL
Q
G20

ELECTRONIC TOWEL DISPENSER

BACKGROUND OF THE INVENTION

This invention relates generally to continuous towel dispensers and is particularly directed to a continuous towel dispenser which employs solid state sensing and control circuitry as well as a novel towel withdrawing sensor arrangement.

Continuous towel dispensers typically include a cabinet containing a supply roll of clean toweling. The roll of clean toweling is generally supported in the cabinet in a manner to allow its rotation to permit the clean toweling to be dispensed from the cabinet. The clean toweling is commonly fed out of a front or lower portion of the cabinet via a slot therein so as to form a towel loop which hangs beneath the cabinet. The front or forward leg of the loop is in the use position and is grasped and pulled down during a use cycle. The towel loop also includes a rear leg which extends upward into the dispenser cabinet through a suitable intake slot therein. The thus retracted soiled toweling is then wound onto an uptake roller for storage in the cabinet at the start of each use cycle. Examples of continuous towel dispensers of this type can be found in U.S. Pat. Nos. 3,858,953 and 3,893,738, both assigned to the assignee of the present application.

The soiled towel loop is automatically withdrawn from its use position into the cabinet when a user has completed the drying operation. Automatic roll-up of the soiled towel avoids the unpleasant appearance of the exposed soiled toweling as well as the possibility of the next user contacting the previously soiled toweling.

In some dispensers, discharge of the clean toweling as well as release of a predetermined section of used toweling is initiated by user responsive actuating means. In this type of dispenser it is not necessary for the user to first grasp and then pull out the clean toweling as this is accomplished automatically by user actuation. The actuation means may be in the form of a mechanical or electromechanical switch typically on the dispenser cabinet which is engaged by the user for clean toweling release. Another well known arrangement makes use of a light beam which is interrupted when the user's hands are positioned in contact with or in the vicinity of the toweling. The latter arrangement, which typically makes use of an infrared (IR) beam, employs a photocell. U.S. Pat. No. 4,676,131, also assigned to the assignee of the present application, discloses a paper towel dispenser employing the combination of a phototransistor and a light emitting diode (LED) responsive to the presence of a user's finger or hand in a recess in the dispenser cabinet for initiating automatic dispensing of a selected length of paper towel. The use of mechanical switches limits the reliability of the towel dispenser, while the opto coupler arrangement increases dispenser complexity and renders it more susceptible to extraneous inputs causing unwanted towel release.

In addition, prior art towel discharge and takeup sensors and controllers have been somewhat imprecise in the length of toweling released and rolled up during each use cycle. The payout of precisely measured clean towel lengths each cycle is highly desirable from a user's standpoint, while imprecise roll-up of the used toweling will result in towel storage problems. More specifically, the used, soiled toweling requires more space to store than the clean toweling. It is therefore essential that the used toweling be tightly wound around the takeup roll to permit all of the toweling, after use, to be stored within the dispenser cabinet.

The present invention provides all of the aforementioned desirable operating features in a continuous towel dispenser and thus overcomes the limitations of the prior art by affording an electronic controller for a continuous towel dispenser which makes use of a novel sensor arrangement, employs solid state electronics, and permits various operating parameters of the dispenser to be established as desired. The novel sensor arrangement makes the present invention highly insensitive to extraneous inputs from the environment, while the unique control arrangement of the present invention permits the towel to remain in the extended, use configuration as long as it is engaged by a user and to be automatically retracted after it is used.

OBJECTS AND SUMMARY OF THE INVENTION

Accordingly, it is an object of the present invention to provide a highly reliable and sensitive motion sensor.

It is another object of the present invention to provide an improved electronically controlled continuous towel dispenser.

Yet another object of the present invention is to provide an improved sensor for a continuous towel dispenser for detecting engagement of the towel by a user.

Still another object of the present invention is to provide for the precise payout of a predetermined length of towel during each use cycle in a continuous towel dispenser.

A further object of the present invention is to provide a controller for a continuous towel dispenser which allows for the use of solid state electronic components rather than manual switches and electromechanical timing devices.

A still further object of the present invention is to provide an electronic towel dispensing controller which allows the towel to remain withdrawn from the cabinet so long as it is being used and automatically retracts the soiled towel when no longer in use.

Another object of the present invention is to provide a towel use sensor for a continuous towel dispenser which is integrated with the dispenser's cabinet and does not require contact or engagement by a user.

Still another object of the present invention is to provide the capability in a continuous towel dispenser to establish as desired: (1) the length of towel withdrawn for use; (2) the time the towel remains withdrawn before it is automatically retracted; and (3) the time interval before the next towel withdrawal cycle can be initiated.

Yet another object of the present invention is to detect the position of a continuous towel in a towel dispenser using drive motor current sensors rather than mechanical switches.

The present invention contemplates a continuous towel dispenser including a cabinet for dispensing a predetermined length of clean towel from the cabinet at a towel use position and for storing the towel after it is soiled during use. The continuous towel dispenser further includes a motion sensor for detecting movement within the towel use position and providing a first control signal in response thereto; towel discharge means coupled to the motion sensor and responsive to the first control signal for discharging a predetermined length of clean towel at the towel use position in response to removal of the towel from the cabinet by a user; an idler roller coupled to and providing support for the soiled towel after it is used, with the idler roller movable from a first position to a second position in response to removal of the towel from the cabinet by a user; displacement means coupled to the idler roller and to the motion sensor and responsive to an absence of the first control signal from the motion sensor indicating no movement within the towel use position for moving the idler roller from the second to the first position in drawing the soiled towel into the cabinet; and towel takeup means coupled to the idler roller and responsive to its position for rolling up the soiled towel within the cabinet after the idler roller is moved to the first position.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference identify like elements throughout the various figures, in which:

DETAILED DESCRIPTION OF THE PREFERRED EMBODIMENT

Figure 1:
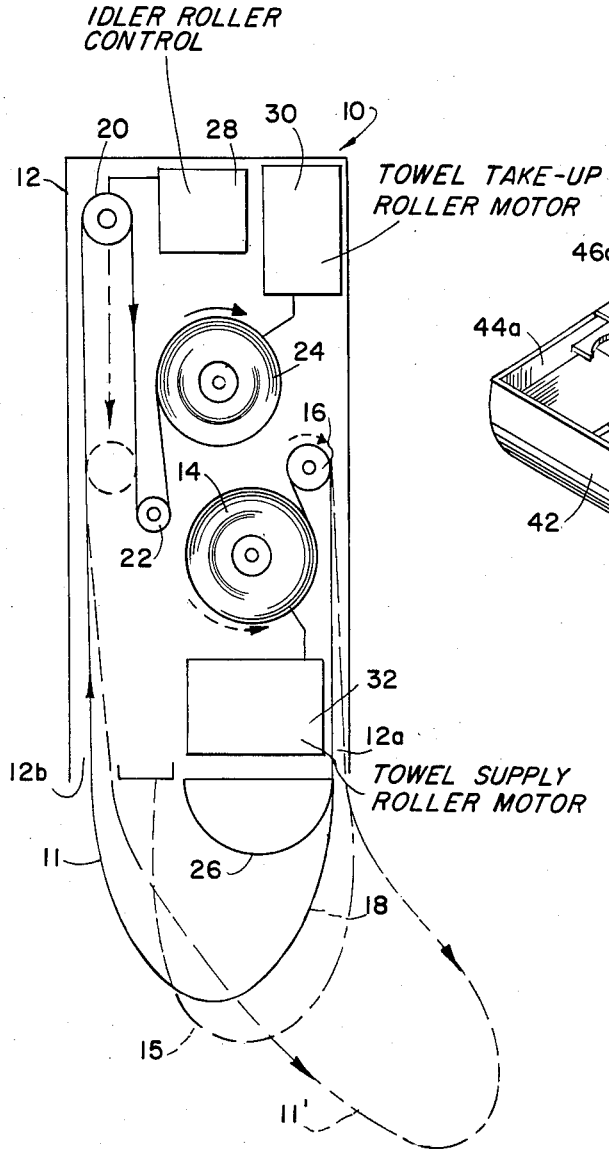
FIG. 1 is a partially cutaway simplified schematic diagram of an electronic towel dispenser in accordance with the present invention.

Referring to FIG. 1, there is shown a simplified schematic sectional view of an electronic towel dispenser 10 in accordance with the principles of the present invention.

The electronic towel dispenser 10 includes a cabinet 12 preferably comprised of a sheet-like metal and incorporating a towel dispensing slot 12*a* and a towel return slot 12*b* on a lower portion thereof. Positioned within the cabinet 12 is a supply roll 14 on which is wrapped clean towel. The clean towel is directed from the supply roll 14 over a first guide roller 16 and thence through the towel dispensing slot 12*a* through which the entire roll of towel 11 may be drawn from the cabinet 12. The towel 11 extends in a generally semi-circular shape from the towel dispensing slot 12*a* to the towel return slot 12*b* where it re-enters the cabinet 12 and is wrapped around the combination of an idler roller 20, a second guide roller 22 and a takeup roll 24.

When the towel 11 is withdrawn from the cabinet 12 by a user, it is typically drawn downward and outward, or to the right as shown in FIG. 1, away from the cabinet. A towel in the use position after it has been withdrawn from the cabinet 12 is shown in dotted line form in the figure and is represented as element 11′ therein. When the towel 11 is grasped and drawn out of the cabinet 12 by a user, clean towel is drawn from the supply roll 14 over the first guide roller 16 and out of the towel dispensing slot 12*a*. Similarly, during a use cycle soiled towel is drawn out of the cabinet 12 through the towel return slot 12*b* by the downward displacement of the idler roller 20 as shown by the direction of the arrow in FIG. 1. This towel dispensing arrangement is conventional and conserves towel usage by ensuring that only the clean towel portion withdrawn from the cabinet is positioned immediately in front of the user and that the soiled towel portion is positioned away from the user. This arrangement also ensures that clean and soiled towel portions each comprise approximately one-half the towel length withdrawn from the cabinet 12 during each use cycle.

A motion sensor 26 is mounted to a lower portion of the cabinet 12 and defines a towel use position, or volume, indicated in dotted line form in FIG. 1 and identified by numeral 15 in the figure. In general, the towel use position 15 defined by the sensor 26, details of which are described below, is in the form of a generally curvilinear, closed volume positioned beneath the cabinet 12. The motion sensor 26 is responsive to the movement of an object such as a user's hand within the towel use position 15 for providing a control signal to a towel supply roller motor 32. The towel supply roller motor 32 is positioned within the cabinet 12 and is coupled to and drives the supply roll 14. In response to an appropriate control signal from the sensor 12, the towel supply roller motor 32 rotationally displaces the supply roll 14 in unrolling the towel 11 and allowing the towel to be pulled over the first guide roller 16 and to be withdrawn from the cabinet 12 through the towel dispensing slot 12*a*. In a preferred embodiment, the sensor 26 is a radio frequency (RF) field sensor capable of detecting small changes in the RF field below the cabinet 12 arising from the movement of an object, such as a hand, which causes a change in this RF field. Timing means, not shown in FIG. 1 but described in detail below, is coupled to the towel roller motor 32 for allowing the supply roll 14 to be rotationally displaced for a predetermined time period to ensure that a designated length of clean towel is removed from the supply roll 14 and withdrawn from the cabinet 12 during each use cycle.

Detection of a moving object within the towel use position 15 by the motion sensor 26 also causes the motion sensor to provide an appropriate control signal to an idler roller control 28 positioned within the cabinet and coupled to the idler roller 20. In response to the control signal received from the motion sensor 26, the idler roller control 28 provides for downward displacement of the idler roller 20 as shown by the direction of the arrow in FIG. 1, whereupon the idler roller assumes a position indicated in dotted line form in the figure. This downward displacement of the idler roller 20 allows previously soiled towel to be withdrawn from the cabinet 12 via the towel return slot 12*b* during a use cycle. The length of towel thus withdrawn from the cabinet 12 during a use cycle is comprised of one-half portion soiled towel and one-half portion clean towel, with the clean towel portion disposed immediately in front of a user in the towel use position 15. A bar down limit switch (not shown) detects when the idler roller 20 is in the full down position for terminating further downward movement of the idler roller by the idler roller control 28.

Following a towel use cycle, the idler roller 20 is displaced upward by the idler roller control 28, with a bar up limit switch detecting the idler roller in the full up position. Upon displacement of the idler roller 20 to the full up position, the towel takeup roll 24 is rotationally displaced by a towel takeup roller motor 30 in order to wind the soiled towel onto the takeup roll via the idler roller and the second guide roller 22.

Figure 2:
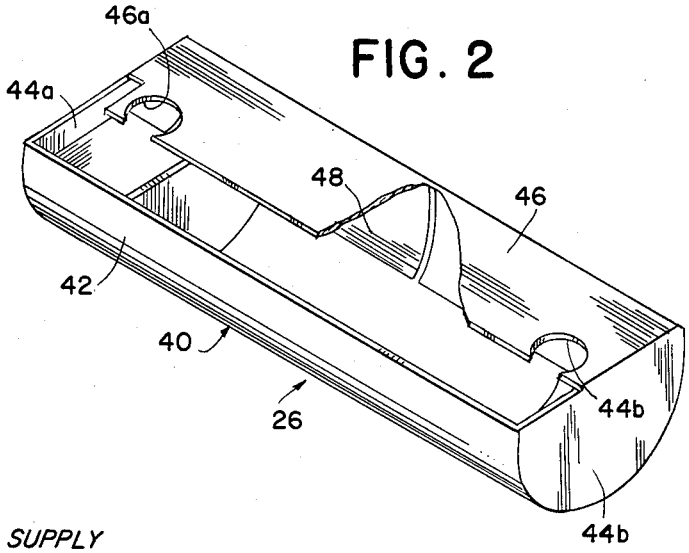
FIG. 2 is a partially cutaway perspective view of a radio frequency (RF) sensor for use in the electronic towel dispenser of the invention.
Figure 3:
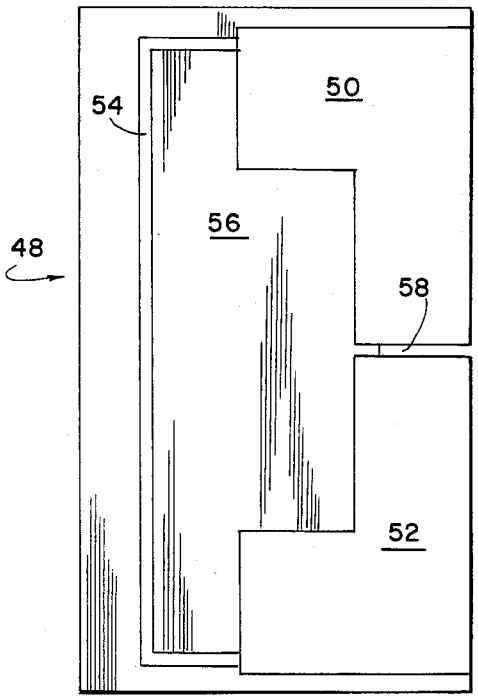
FIG. 3 is a planar view of a field sensing coil used in the RF illustrated in FIG. 2.

Referring to FIG. 2, there is shown a partially cutaway upper perspective view of the sensor 26 used in a preferred embodiment of the present invention. The sensor 26 includes a coil 48 shown in planar view in FIG. 3. The sensor 26 is securely mounted to a lower portion of the cabinet 12 by conventional means such as threaded coupling members or clips, which are not shown in the figures for simplicity. The sensor 26 includes an elongated, half cylinder-shaped housing 40 having opposed, closed end sections 44*a* and 44*b*. The upper, open portion of the sensor housing 40 is provided with a generally flat cover 46 having a plurality of spaced mounting apertures 46*a* and 46*b* therein for securely attaching the sensor to the lower portion of the towel dispenser cabinet.

Positioned on the inner surface of the sensor housing 40 and extending the length thereof is the coil 48. The coil 48 includes a pair of generally flat conductors 50 and 52 positioned upon a substrate 56. The substrate 56 is preferably comprised of a nonconductive, flexible material. The two flat conductors 50, 52 positioned on the substrate 56 are coupled by means of a strip-like conductor 54 and are separated by a slot 58 on the surface of the substrate. The coil 48 forms part of an oscillator circuit described below. Operation of the oscillator circuit causes the coil 48 to generate an RF field defined by its shape. With the coil 48 arranged in a semicircular configuration within the sensor housing 40, the shape of the RF field generated by the coil corresponds to the shape of the towel use position, or volume, 15 shown in FIG. 1. The RF field is thus of a generally half cylindrical shape extending below the cabinet 12 and substantially the entire width thereof. Movement of an object which changes the magnitude of the RF field within this position causes the loading on the coil 48 to change resulting in a change in the current within the oscillator circuit. This change in the current in the sensor's oscillator circuit causes the sensor to provide appropriate control signals to the towel supply roller motor 32 and the idler roller control 28, as previously described.

Figure 4:
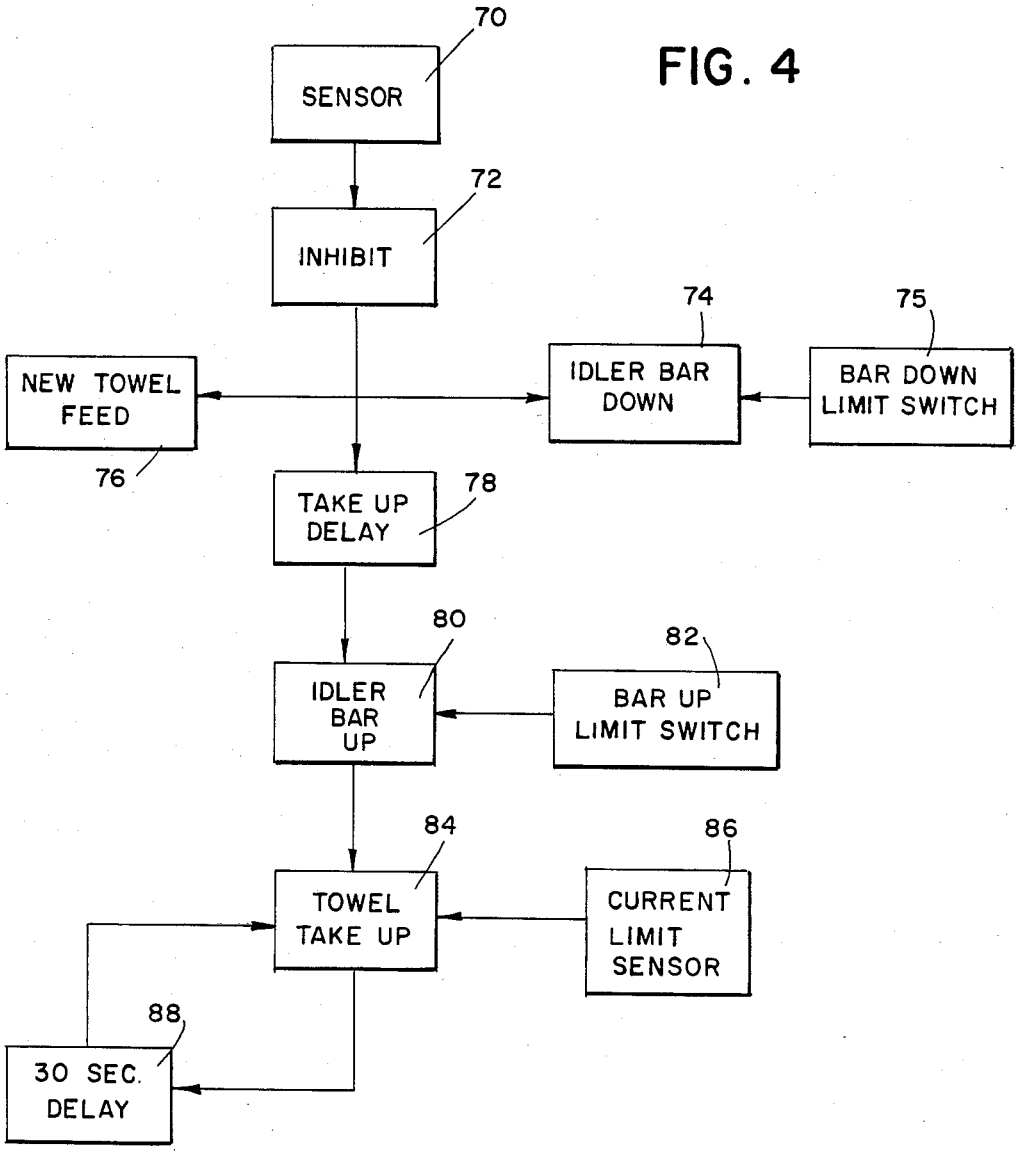
FIG. 4 is a simplified block diagram of the functions carried out by the electronic towel dispenser of the present invention.

Referring to FIG. 4, there is shown a functional block diagram illustrating additional details of the operation of the electronic towel dispenser of the present invention. In the sensor block 70, the RF sensor provides proximity detection of a user's hand in the towel use position to initiate a towel use cycle as previously described. The output of the RF sensor is a series of pulses as it detects the moving hand within the designated towel use position. An inhibit block 72 functions as a gate for either transmitting the output pulses of the sensor or, when activated, preventing the sensor's output pulses from traveling further. If the inhibit block 72 transmits the output pulses of the RF sensor, these pulses are provided to the towel supply roller motor 32, allowing clean towel to be dispensed for a predetermined time period which corresponds to a designated length of clean towel. This operation is depicted in FIG. 4 as the new towel feed block 76. Also in response to output of the aforementioned pulses by the RF sensor and their transmission by the inhibit block 72, the idler roller control 28 initiates a bar down operation 74 in lowering the idler roller 20 as previously described. The bar down limit switch 75 provides a control signal to the bar down function block 74 upon detection of the idler roller 20 in the full down position in order to stop further downward movement of the idler roller.

The pulsed output of the RF sensor 70 is also provided via the inhibit block 72 to a takeup delay timer block 78. The takeup delay timer 78 is a variable timer circuit which delays the start of the towel takeup cycle. This delay is nominally set for 2 seconds, but is adjustable by 2–3 seconds. Following the delay introduced by the takeup delay function block 78, a bar up operation 80 is performed resulting in upward displacement of the idler roller 20 to its start position. This is accomplished by reversing the direction of operation of the idler roller control 28 to effect opposite displacement of the idler roller 20. The full-up position of the idler roller 20 is detected by a bar up limit switch at block 82 for terminating further upward movement of the idler roller.

Following upward displacement of the idler roller 20 performed in the bar up block 80, the towel takeup roller motor 30 is actuated for rotationally displacing the takeup roll 24 and rolling up the used towel onto the takeup roll. The towel takeup operation 84 is a timed function which will continue after initiation for 30 seconds unless interrupted. A current limit sensor function 86 is performed for sensing the current in the towel takeup roller motor 30. When the soiled towel is tightly wound onto the takeup roll 24, the towel takeup roller motor 30 momentarily stalls causing an increase in current in the drive circuit for the towel takeup roller motor which is detected by a current limit sensor. If a stall of the towel takeup roller motor 30 is detected, a stop signal is provided to the towel takeup function by the current sensor limit function 86 to terminate rolling up of the soiled towel. After a 30 second delay, performed at block 88, a second towel takeup operation at block 84 is initiated to ensure that the towel is not left hanging from the dispenser cabinet if the previous towel use cycle was interrupted before completion. The second towel takeup cycle is terminated either upon detection of a stall of the towel takeup roller motor 30 or running of the 30 second delay at block 88 without interruption.

Figure 5:
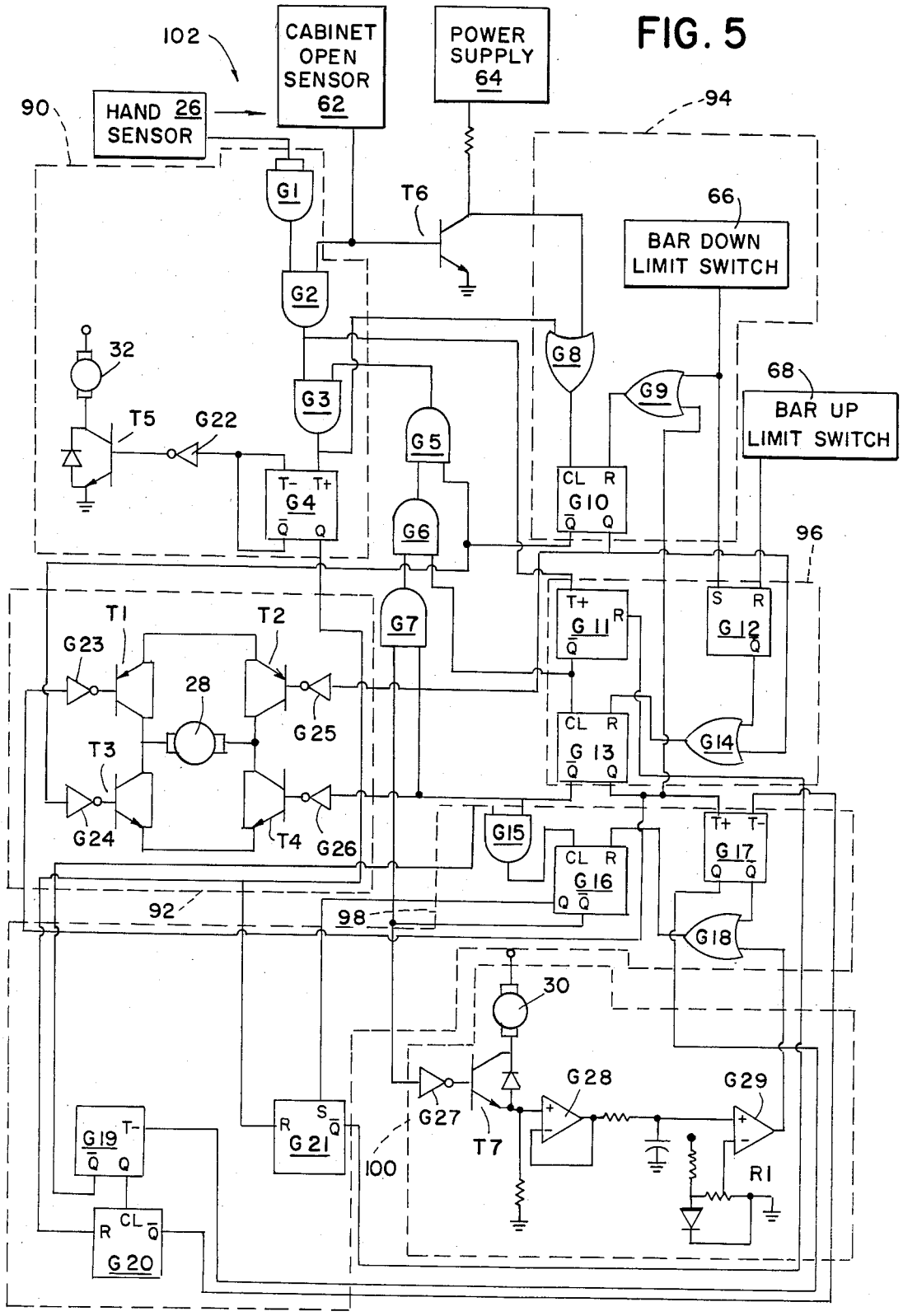
FIG. 5 is a combined block and schematic diagram of an electronic towel dispenser in accordance with the present invention.

Referring to FIG. 5, there is shown a combined block and schematic diagram of an electronic control circuit 102 used in a preferred embodiment of the towel dispenser of the present invention. The towel dispenser electronic control circuit 102 includes a clean towel feed circuit 90, an idler bar, or roller, controller 92, an idler bar direction sensor 94, a timer circuit 96, a towel takeup cycle controller 98, and a towel takeup roller motor control 100. The clean towel feed circuit 90 is responsive to the output pulse sequence from the hand sensor 26 which is buffered by AND gate G1. AND gate G2 combines the buffered pulse sequence output from gate G1 with a "cabinet open" signal from a cabinet open sensor 62 to prevent operation of the electronic towel dispenser during servicing of the dispenser. The output of gate G2 is combined with feedback signals from a timer circuit 96, which combined signals are provided to one input of AND gate G3 to inhibit initiation of multiple towel feed cycles during usage. Various timing feedback signals are combined by AND gates G5, G6 and G7. The output of gate G3 is provided to gate G4, the output of which drives the towel feed motor, or supply roller motor, 32 via an inverter G22 and an NPN transistor T5 for a predetermined period of time at the start of a towel use cycle so as to dispense a fixed length of new towel from the supply roll 14 as shown in FIG. 1 and discussed above. The output of gate G3 provides the trigger input signal for gate G4 in actuating the towel supply roller motor 32.

Transistors T1, T2, T3 and T4 in combination with inverters G23, G24, G25 and G26 comprise the idler bar controller 92 for controlling the operation of the idler bar control motor 28. The idler bar control motor 28 controls the upward and downward displacement of the idler roller 20 as previously described. The operation and direction of the idler bar control motor 28 is determined by the output of gate G10 which is in the idler roller bar direction sensor 94. The trigger input signal to gate G10 is provided from gate G3 via OR gate G8 during normal operation for downward displacement of the idler roller as previously described. During servicing of the electronic towel dispenser, the trigger input signal to gate G10 is provided from the cabinet open sensor 62 via transistor T6 and gate G8. During servicing of the electronic towel dispenser, the trigger input signal to gate G10 from the cabinet open sensor 62 provides for downward displacement of the idler roller to the full down position. The idler roller bar direction sensor 94 includes a bar down limit switch 66 which detects full downward displacement of the idler roller. A signal indicating full downward displacement of the idler roller is provided by the bar down limit switch 66 to OR gate G9 and thence to the idler bar controller 92 via gate G10 for terminating downward displacement of the idler roller.

The timer circuit 96 includes gates G11, G12 and G13 in combination with OR gate 14. The timer circuit 96 is responsive to inputs from a bar up limit switch 68 as well as from gate G2 in the clean towel feed circuit 90. The trigger input for gate G11 in the timer circuit 96 is the pulse sequence output of gate G2 in the clean towel feed circuit 90. The R output of gate G11 provided to the towel takeup cycle controller 98 determines the length of time for the takeup delay before the soiled toweling is retracted into the cabinet of the electronic towel dispenser. The output of gate G13 is also provided to the towel takeup cycle controller 98 for initiating the start of an idler bar up cycle. An idler bar up cycle terminates upon receipt of an output from the bar up limit switch 68 provided to gate G12, the output of which is provided to gate G13 via OR gate G14 in the timer circuit 96.

A towel takeup cycle is initiated at the completion of an idler bar up cycle and is controlled by gate G16. A signal indicating completion of the idler bar up cycle is provided to gate G16 via AND gate G15. The correct sequence of cycle events is determined by output signals from gates G19 and G20 within the towel takeup cycle controller 98. A 30 second delay signal from gate G20 provided to gate G16 via gate G15 initiates another towel takeup cycle to ensure complete retraction of soiled towel into the cabinet of the electronic towel dispenser.

The towel takeup cycle is initiated at the completion of the idler bar up cycle by the $\overline{Q}$ output from gate G16 provided to the towel takeup roller motor controller 100. The output from gate G16 is provided via an inverter G27 and NPN transistor T7 to the towel takeup roller motor 30 for initiating its operation in rolling up soiled towel into the cabinet of the towel dispenser. Upon completion of an idler bar up cycle, the $\overline{Q}$ output from gate G13 is provided to gate G15 which, in turn, provides a signal to the CL input of gate G16. Gate G16 then provides its $\overline{Q}$ output to the towel takeup roller motor 30 for initiating a towel takeup cycle as previously described. The correct sequence of the idler bar up cycle and the towel takeup cycle is determined by output signals from gates G19 and G20. The towel takeup roller motor controller 100 further includes a current limit sensor comprised of an RC network in combination with gates G28 and G29 for terminating the operation of the towel takeup roller motor 30 at the end of a towel takeup cycle. A 30 second delay signal at the R output of gate 20 which is provided to gate G16 via gate G15 initiates resumption of the towel takeup cycle to ensure complete retraction of soiled towel into the dispenser's cabinet.

There has thus been shown an improved electronic towel dispenser which incorporates a radio frequency sensor for detecting the presence of a user's hands beneath the dispenser's cabinet for initiating a towel dispensing cycle. Following the dispensing of both clean and soiled towel, a towel takeup cycle is automatically initiated following a predetermined time delay. The towel takeup cycle continues for a designated time period or until a stall current is detected in a towel takeup motor indicating that all of the soiled towel has been withdrawn into the dispenser's cabinet. The RF sensor is integrated with the dispenser's cabinet and does not require contact or engagement by a user.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A continuous towel dispenser including a cabinet having means therein for dispensing a predetermined length of clean towel from said cabinet at a towel use position and for storing the towel after it is soiled during use, said dispenser comprising: a motion sensor for detecting movement by the towel user within the towel use position and providing a first control signal in response thereto; towel discharge means coupled to said motion sensor and responsive to said first control signal for discharging a predetermined length of clean towel at the towel use position in response to removal of the towel from the cabinet by a user; an idler roller mounted in said cabinet coupled to and providing support for the soiled towel after it is used, said idler roller movable from a first position wherein a length of towel is stored in said cabinet to a second position wherein a portion of the towel stored in the first position is available outside said cabinet, said movement of said idler roller being in response to removal of the towel from the cabinet by a user; displacement means coupled to said idler roller and to said motion sensor and responsive to an absence of said first control signal from said motion sensor indicating no movement within the towel use position for moving said idler roller from said second to said first position in drawing the soiled towel into the cabinet; and towel takeup means coupled to said idler roller and responsive to its position for rolling up the soiled towel within the cabinet after said idler roller is moved to said first position.

2. The continuous towel dispenser of claim 1 wherein said motion sensor is mounted to a lower portion of the cabinet and the towel use position is disposed immediately below the cabinet.

3. The continuous towel dispenser of claim 2 wherein the cabinet includes towel discharge and inlet slots disposed on a lower portion of the cabinet with said motion sensor disposed therebetween.

4. The continuous towel dispenser of claim 3 further comprising an elongated semi-circular housing attached to a lower portion of the cabinet for enclosing and supporting said motion sensor.

5. The continuous towel dispenser of claim 1 wherein said motion sensor includes an RF field sensor.

6. The continuous towel dispenser of claim 5 wherein said RF field sensor comprises a coil forming a portion of an oscillator circuit and generating an RF field defining the towel use position.

7. The continuous towel dispenser of claim 6 wherein the configuration of said coil defines the location and shape of the towel use position.

8. The continuous towel dispenser of claim 6 wherein said oscillator circuit has a characteristic operating point defined by an electronic current, with said electronic current and said characteristic operating point changing upon detection of a moving object within the towel use position by said RF field sensor.

9. The continuous towel dispenser of claim 1 wherein said towel discharge means includes, in combination, a roller and an electric motor.

10. The continuous towel dispenser of claim 9 wherein said towel discharge means further includes timing means coupled to said electric motor for discharging clean towel for a predetermined time period corresponding to a designated length of clean towel.

11. The continuous towel dispenser of claim 10 wherein said timing means includes an RC network having a characteristic time constant defining said predetermined time period.

12. The continuous towel dispenser of claim 9 wherein said RC network includes a manually variable resistor for changing said time constant and fixing the length of clean towel discharged, as desired.

13. The continuous towel dispenser of claim 1 wherein said displacement means includes an electric motor coupled to said idler roller in combination with first and second limit switches for displacing said idler roller and detecting said idler roller in said first and second positions.

14. The continuous towel dispenser of claim 1 further comprising timing means coupled to said displacement means for introducing a predetermined time delay prior to moving said idler roller from said second position to said first position in the absence of said first control signal from said motion sensor.

15. The continuous towel dispenser of claim 14 wherein said timing means includes an RC network having a characteristic time constant defining said predetermined time delay.

16. The continuous towel dispenser of claim 15 wherein said RC network includes a manually variable resistance for changing said time constant and fixing the time said idler roller is in said second position, as desired.

17. The continuous towel dispenser of claim 1 wherein said towel takeup means includes, in combination, a roller and an electric motor.

18. The continuous towel dispenser of claim 17 further comprising first timing means coupled to said electric motor and to said motion sensor for actuating said electric motor for a first predetermined time period unless interrupted by detection of movement within the towel use position by said motion sensor.

19. The continuous towel dispenser of claim 18 wherein said first timing means includes an RC network having a characteristic time constant.

20. The continuous towel dispenser of claim 19 wherein said RC network includes a manually variable resistor for allowing said first predetermined time period and the time before additional towel can be removed from the cabinet after initial towel withdrawal from the cabinet to be fixed, as desired.

21. The continuous towel dispenser of claim 17 further comprising stall detection means coupled to said electric motor for detecting when the rotational speed of said electric motor approaches zero indicating that the soiled towel is tightly wound on said takeup roller.

22. The continuous towel dispenser of claim 21 wherein said stall detection means includes a current sensor for detecting current in said electric motor.

23. The continuous towel dispenser of claim 22 further comprising second timing means coupled to said electric motor for actuating said motor for a second predetermined time period following said first predetermined time period for rolling up the towel if said electric motor is interrupted by engagement of the towel by a user during said first predetermined time period.

* * * * *